US006172133B1

(12) United States Patent
Kiuchi et al.

(10) Patent No.: US 6,172,133 B1
(45) Date of Patent: Jan. 9, 2001

(54) CAKING ADDITIVE COMPOSITION FOR FORMING SELF-HARDENING MOLD

(75) Inventors: Kazuhiko Kiuchi; Masayuki Kato; Masahiko Kagitani, all of Aichi (JP)

(73) Assignee: Kao Corporation, Tokyo (JP)

( * ) Notice: Under 35 U.S.C. 154(b), the term of this patent shall be extended for 0 days.

(21) Appl. No.: 09/202,536

(22) PCT Filed: Jun. 6, 1997

(86) PCT No.: PCT/JP97/01931

§ 371 Date: Dec. 16, 1998

§ 102(e) Date: Dec. 16, 1998

(87) PCT Pub. No.: WO97/49513

PCT Pub. Date: Dec. 31, 1997

(30) Foreign Application Priority Data

Jun. 25, 1996 (JP) ..... 8-164387

(51) Int. Cl.[7] ..... B22C 1/22
(52) U.S. Cl. ..... 523/139; 523/145
(58) Field of Search ..... 523/145, 139, 523/146, 141; 525/505

(56) References Cited

U.S. PATENT DOCUMENTS

| | | | | |
|---|---|---|---|---|
| Re. 32,812 | * | 12/1988 | Lemon et al. | 523/145 |
| 3,300,427 | | 1/1967 | Herbert . | |
| 4,195,458 | * | 4/1980 | Hoppe et al. | 52/234 |
| 4,444,912 | * | 4/1984 | Carlson et al. | 521/121 |
| 4,587,291 | | 5/1986 | Gardziella et al. . | |
| 4,740,535 | * | 4/1988 | Iyer et al. | 523/145 |
| 4,942,217 | * | 7/1990 | Gardziella et al. | 528/129 |
| 5,182,346 | * | 1/1993 | Gerber | 525/503 |
| 5,182,347 | * | 1/1993 | Gerber | 528/140 |
| 5,218,010 | * | 6/1993 | Gerber | 523/145 |
| 5,234,973 | * | 8/1993 | Iyer et al. | 523/145 |
| 5,457,142 | * | 10/1995 | Dando et al. | 523/139 |
| 5,491,180 | * | 2/1996 | Kiuchi et al. | 523/139 |
| 5,602,192 | * | 2/1997 | Yoshida et al. | 523/145 |
| 5,646,199 | * | 7/1997 | Yoshida et al. | 123/139 |
| 5,747,599 | * | 5/1998 | Ohnishi | 525/327.3 |

FOREIGN PATENT DOCUMENTS

| | | |
|---|---|---|
| 56-56753 | 5/1981 | (JP) . |
| 58-136648 | 8/1983 | (JP) . |
| 2 5846375 | 10/1983 | (JP) . |
| 61-273237 | 12/1986 | (JP) . |
| 3-52743 | 3/1991 | (JP) . |

* cited by examiner

*Primary Examiner*—Edward J. Cain
*Assistant Examiner*—Katarzyna Wyrozebski
(74) *Attorney, Agent, or Firm*—Birch, Stewart, Kolasch & Birch, LLP

(57) ABSTRACT

The present invention relates to a specific binder composition for molding by self-hardening comprising 6.0 to 25.0% by weight of metal salts of aliphatic sulfonic acid, a specific hardener composition for molding by self-hardening comprising 0.5 to 20.0% by weight of metal salts of aromatic sulfonic acid, and a sand composition for molding by self-hardening comprising said binder composition for molding by self-hardening and/or said hardener composition for molding by self-hardening.

12 Claims, No Drawings

CAKING ADDITIVE COMPOSITION FOR FORMING SELF-HARDENING MOLD

This application is the national phase under 35 U.S.C. §371 of prior PCT International Application No. PCT/JP97/01931 which has an International filing date of Jun. 6, 1997 which designated the United States of America.

BACKGROUND OF THE PRESENT INVENTION

1. Field of the Invention

The present invention relates to a binder composition that can preferably be used in particularly molding by self-hardening.

2. Prior Art

As one conventional method of molding by self-hardening, a hardener and a binder such as phenol-formaldehyde polycondensate, phenol-formaldehyde-urea polycondensate, furfuryl alcohol-phenol-formaldehyde polycondensates, furfuryl alcohol-phenol-formaldehyde-urea polycondensate or the like are blended and mixed with a refractory granulated aggregate such as silica sand or the like to mold at room temperature.

However, the rate of hardening of the binder is generally slow in such conventional method, so molding productivity cannot be maintained at particularly at low temperatures in the winter, unless the content of sulfuric acid in a hardener composition for molding is increased to accelerate hardening. However, use of such a hardener composition for molding reduces the final strength of the resultant mold. Accordingly, the countermeasure of maintaining the productivity and the final strength of molds at practically feasible levels has been conducted for example by increasing the amount of a binder.

Under these circumstances, some binders are examined. For example, JP-A 56-56753 proposes use of a resol type phenol formaldehyde resin containing a small amount of low-molecular components. If the resol type phenol formaldehyde resin containing a small amount of low-molecular components is used, the rate of polymerization of the resin composition can be accelerated the strength of the resultant mold at an early stage can thereby be improved. However, even use of the resol type phenol formaldehyde resin containing a small amount low-molecular components does not bring about an adequate rate of hardening of a mold in winter, thus failing to achieve suitable molding productivity. To solve this, use of a hardener composition for molding with an increased content of sulfuric acid leads to a certain improvement in the rate of hardening the mold in winter, but practical mold strength cannot be achieved.

JP-B 58-46375 proposes use of a resol type phenol formaldehyde resin with a content of high molecular weight compounds with 3 or more nuclei being limited to a specific range. Use of the resol type phenol formaldehyde resin with a controlled molecular weight enables production of high-strength molds with low bad smells. However, even use of the resol type phenol formaldehyde resin with a content of high molecular weight compounds with 3 or more nuclei being limited to a specific range does not bring about an adequate rate of hardening of a mold in winter, thus failing to achieve suitable molding productivity. To solve this, use of a hardener composition for molding with an increased content of sulfuric acid leads to a certain improvement in the rate of hardening of the mold in winter, but practical mold strength cannot be achieved.

Further, even in JP-B 56-46275 and JP-B 56-46375 mentioned above, an alkali catalyst used in producing the resol type phenol formaldehyde resin is neutralized with an acid after Reaction. Its precipitates are separated by filtration or by other means, so a binder with an extremely low content of a neutralized salt has generally been used.

A thermal hardening resin composition containing an organic sulfonate for acceleration of hardening is proposed in JP-A 58-136648; a sand composition for molding having a transition metal salt of p-toluene sulfonic acid incorporated therein for the purpose of reducing consumption of heat energy and preventing generation of fin is proposed in JP-A 61-273237; and a thermal hardening composition for molding having a salt of organic sulfonic acid with a weak base incorporated therein for the purpose of improving initial strength is proposed in JP-A 3-52743. However, these methods, unlike the present invention, are related to thermal hardening methods.

In addition, U.S. Pat. No. 3,300,427 proposes an aqueous solution of resol resin containing a sulfonic acid type anion activator for the purpose of a useful process for producing a resol resin. However, unlike the present invention, this prior art is related to an aqueous solution of resol resin containing a long-chain sulfonate activator.

DISCLOSURE OF THE INVENTION Summary of the invention

The present invention attempts to improve mold strength by incorporating a specific compound into a binder, a hardener or sand, unlike the aforementioned JP-A 56-56753, JP-B 58-46375, JP-A 58-136648, JP-A 61-273237, JP-A 3-52743, and U.S. Pat. No. 3,300,427 which are based on control of molecular weight.

As a result of their eager study for solving the above problem, the present inventors arrived at completion of a binder composition for molding satisfying both the initial strength and final strength of a mold by adding a metal salt of organic sulfonic acid to a binder composition, a hardener composition or a sand composition.

That is, the present invention relates to a binder composition for molding comprising a resol type phenol resin, said binder composition comprising 6.0 to 25.0% by weight of metal salts of organic sulfonic acid.

Further, the present invention relates to a hardener composition for molding to harden a binder composition for molding comprising a resol type phenol resin, said hardener composition comprising 0.5 to 20.0% by weight of metal salts of organic sulfonic acid.

Further, the present invention relates to a sand composition for molding which is obtained by mixing a refractory granulated aggregate, a binder composition for molding containing a resol type phenol resin, and a hardener composition for molding, wherein the binder composition for molding and/or the hardener composition for molding is the above binder composition for molding or the above hardener composition for molding.

Further, the present invention relates to a sand composition for molding which is obtained by mixing a refractory granulated aggregate, a binder composition for molding containing a resol type phenol resin, a hardener composition for molding, and a metal salt of organic sulfonic acid, wherein the metal salt of organic sulfonic acid is contained in an amount of 0.02 to 0.8% by weight in the sand composition.

The present invention relates to a binder composition for molding by self-hardening comprising a resol type phenol resin, which further comprises 6.0 to 25.0% by weight of an alkali metal salt or an alkaline earth metal salt of aromatic sulfonic acid.

Further, the present invention relates to a hardener composition for molding by self-hardening to harden a binder composition for molding by self-hardening comprising a resol type phenol resin, said hardener composition comprising 0.5 to 20.0% by weight of an alkali metal salt or an alkaline earth metal salt of aromatic sulfonic acid.

Further, the present invention relates to a sand composition for molding by self-hardening which is obtained by mixing a refractory granulated aggregate, a binder composition for molding by self-hardening containing a resol type phenol resin, and a hardener composition for molding by self-hardening, wherein the binder composition for molding by self-hardening and/or the hardener composition for molding by self-hardening are the above binder composition for molding by self-hardening or the above hardener composition for molding by self-hardening.

Further, the present invention relates to a sand composition for molding by self-hardening which is obtained by mixing a refractory granulated aggregate, a binder composition for molding by self-hardening containing a resol type phenol resin, a hardener composition for molding by self-hardening, and an alkali metal salt or an alkaline earth metal salt of aromatic sulfonic acid, wherein the alkali metal salt or the alkaline earth metal salt of aromatic sulfonic acid is contained in an amount of 0.02 to 0.8% by weight in the sand composition.

Preferably, the alkali or alkaline earth metal salt of aromatic sulfonic acid in the binder composition for molding by self-hardening, the hardener composition for molding by self-hardening and the sand composition for molding by self-hardening according to the present invention are one or more members selected from compounds of the following general formula (1) or (2):

(1)

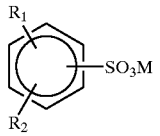

(2)

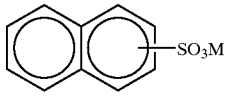

wherein $R_1$ and $R_2$ each are a hydrogen atom or an alkyl group having 1 to 4 carbon atoms, and M is an alkali metal or an alkaline earth metal.

Preferably, the aromatic sulfonic acid in the binder composition for molding by self-hardening according to the present invention is one or more members selected from benzene sulfonic acid, toluene sulfonic acid, xylene sulfonic acid, ethyl benzene sulfonic acid, cumene sulfonic acid, and naphthalene sulfonic acid, and the alkali or alkaline earth metal is one ore more members selected from sodium, potassium, calcium and magnesium.

Preferably, the resol type phenol resin in the binder composition for molding by self-hardening according to the present invention is produced by addition-condensing a phenol compound and an aldehyde compound under alkaline conditions and then neutralizing the alkali with an aromatic sulfonic acid so that the alkali metal salt or the alkaline earth metal salt of aromatic sulfonic acid is contained in the binder.

Preferably, the alkali or alkaline earth metal salt of aromatic sulfonic acid in the binder composition for molding by self-hardening according to the present invention is contained in an amount of 8.0 to 20.0% by weight in the binder composition.

Preferably, the binder composition for molding by self-hardening according to the present invention comprises 30 to 95% by weight of at least one resol type phenol resin, 0.5 to 50% by weight of water and 6.0 to 25.0% by weight of the alkali or alkaline earth metal salt of aromatic sulfonic acid.

Preferably, the resol type phenol resin in the binder composition for molding by self-hardening according to the present invention is produced by using an alkali catalyst at a molar ratio of 0.001 to 0.2 relative to the phenol and has a weight average molecular weight of 200 to 2500.

In the binder composition for molding according to the present invention, the rate of hardening and strength of a mold are improved not by controlling the molecular structure, molecular weight etc. of the binder, but by incorporating a metal salt of organic sulfonic acid into a binder composition, a hardener composition or a sand composition. Accordingly, as a result of acceleration of the rate of hardening a mold, productivity can be improved by adding the hardener in the same amount, and in the case of operation with the same productivity, the amount of the hardener can be reduced or a hardener with lower acidity can be used, resulting in reduction in generation of sulfur dioxide gas etc. and in improvement of work environment.

Further, as a result of the improved strength of the mold, the amount of the binder can be reduced, thus enabling not only economical production but also reduction of the amount of gases generated by pyrolysis of the binder at the time of casting, whereby the quality of molded articles, and work environment, can be improved simultaneously.

DETAILED DESCRIPTION OF THE INVENTION

In the binder composition for molding according to the present invention, 6.0 to 25.0% by weight of metal salts of organic sulfonic acid are used in the binder composition. In particular, the salts of organic sulfonic acid are preferably contained in an amount of preferably 8.0 to 20.0% by weight, most preferably 10.0 to 18.0% by weight. If the content of metal salts of organic sulfonic acid is less than 6.0% by weight, the effect of improving the rate of hardening a mold is poor and the final strength of a mold cannot be achieved to practical levels. If the content of metal salts of organic sulfonic acid exceeds 25.0% by weight., the metal salts are hardly dissolved in the binder, so they precipitate easily and cause the clogging of pumps to make practical application difficult, and there is no further improvement in the strength of the mold, and on the contrary, the strength of the mold may be lowered in some cases.

From the viewpoint of the strength of the mold and the viscosity of the binder composition, the content of the resol type phenol resin in the binder composition for molding according to the present invention is preferably 30 to 95% by weight, more preferably 50 to 90% by weight.

The resol type phenol resin used in the present invention refers to polycondensates in which phenols and aldehydes were addition-condensed under alkaline conditions.

Phenols used for preparing the resol type phenol resin, that is, phenol-aldehyde polycondensates, include phenol, alkyl phenols such as cresol, 3,5-xylenol, nonyl phenol, p-tert-butyl phenol, isopropenyl phenol etc., phenyl phenol, polyhydric phenols such as resorcinol, catechol, hydroquinone, phloroglucinol etc., bisphenols such as bisphenol A, bisphenol F, bisphenol C, bisphenol E etc.

Further, mixtures consisting of phenolic compounds such as cashew nut shell liquid, lignin, tannin etc. can also be used as phenols. One member of these phenols may be used singly, or two or more of these phenols may be mixed and co-condensed with aldehydes.

Aldehydes to be condensed with the phenols include formaldehyde, acetaldehyde, furfural, glyoxal etc.

The amount of aldehydes used is preferably 1.0 to 2.0 in terms of molar ratio relative to phenols. A molar ratio of less than 1.0 relative to phenols is not preferable in view of the strength of the resultant mold, residual phenol smells etc., while a molar ratio of more than 2.0 to phenols is not preferable in view of the strength of the resultant mold, residual aldehyde smells etc.

As the catalyst used for condensation of phenols with aldehyde, use is made of one or more compounds selected from alkali metal hydroxides such as lithium hydroxide, sodium hydroxide, potassium hydroxide etc., alkaline earth metal hydroxides such as calcium hydroxide, magnesium hydroxide, barium hydroxide etc. and ammonia, ammonium hydroxide etc. In particular, potassium hydroxide is used preferably as the catalyst. The amount of these alkaline catalysts is preferably 0.001 to 0.2 in terms of molar ratio to phenols. A molar ratio of less than 0.001 to phenols results in significant reduction in the reaction rate for production of the resol type phenol resin, while a molar ratio of more than 0.2 to phenols fails to achieve further acceleration effects and is thus not economical.

The resol type phenol resin obtained by condensation of phenols with aldehydes may be contained singly in the binder, or a mixture of two or more kinds thereof can be contained in the binder.

The resol type phenol resin in the binder composition for molding according to the present invention is obtained for example by thermal reaction in the temperature range of 40 to 120° C. in the presence of the above-described alkali catalyst until a predetermined molecular weight is reached, followed by cooling and neutralizing the product with e.g. an organic or inorganic acid and as necessary filtering the neutralized salt.

The weight average molecular weight of the resol type phenol resin is preferably 200 to 2500, more preferably 400 to 1500. If the weight average molecular weight is less than 200, the rate of hardening a mold is low and suitable molding productivity cannot be achieved. If the weight average molecular weight exceeds 2500, the viscosity of the binder tends to increase, and suitable molding productivity cannot be achieved.

The method of determining the weight average molecular weight is as follows:

The resol type phenol resin produced in the method described above is dissolved at a concentration of 0.5 to 1.0% by weight in tetrahydrofuran (THF) to prepare a GPC measurement sample. The measurement conditions for GPC are as follows.

Columns: Tosoh Corporation, TSK-GEL G3000 HXL, TS-GEL G2500 HXL

A combination of the columns: A guard column→TSK-guard column HXL-L+TSK-GEL G3000 HXL+TSK-GEL G2500 HXL Standard substance: polystyrene (Tosoh Corporation)

Eluent: THF (flow rate, 1 mg/min.; pressure, 40 to 70 kgf/cm$^2$)

Column temperature: 40° C.

Detector: UV

Resolution method for calculation of molecular weight: time resolution (10 seconds)

The binder composition for molding according to the present invention preferably contains 0.5 to 50% by weight of water. With this water given, the viscosity of the binder composition for molding is reduced so that the composition can be easily handled. If the water content is less than 0.5% by weight, the viscosity of the binder composition for molding tends not to decrease. On the other hand, if the water content exceeds 50% by weight, there is a tendency that the reaction of hardening an acid hardening resin is inhibited and the initial strength of the mold is not adequately improved. If water is to be added to the binder composition for molding, the water may be added later or may be produced at the time of production of the acid hardening resin.

In order to decrease the viscosity of the binder composition for molding according to the present invention, solvents such as alcohols including furfuryl alcohol, methanol, ethanol, isopropyl alcohol etc. may further be contained in the binder composition. In order to reduce free-formaldehyde in the binder composition, urea may be added for denaturation, and a wide variety of conventional denaturants may further be added.

In order to improve the strength of a mold, a silane coupling agent may further be added. The silane coupling agent includes e.g. γ-(2-amino)aminopropyl methyl dimethoxysilane, aminopropyl trimethoxysilane, γ-aminopropyl triethoxysilane, γ-glycidoxypropyl trimethoxysilane etc.

In the present invention, metal salts of organic sulfonic acid (organic sulfonates) are contained in an amount of 0.5 to 20.0% by weight in the hardener composition for molding in order to harden the binder composition for molding. In particular, the organic sulfonates are contained preferably in an amount of 2.0 to 15.0% by weight, most preferably 5.0 to 10.0% by weight. If the content of the metal salts of organic sulfonic acid is less than 0.5% by weight, the effect of improving the rate of hardening a mold is inadequate and the final strength of the mold cannot be achieved to practical levels. On the other hand, if the content of the metal salts of organic sulfonic acid exceeds 20.0% by weight, the metal salts are hardly dissolved in the hardener composition for molding, so they precipitate easily and occur the clogging of pumps to make practical application difficult.

Usually, free organic sulfonic acids are contained in an amount of 5.0 to 95.0% by weight in the hardener composition for molding in order to harden the binder composition for molding. The free organic sulfonic acids include a wide variety of sulfonic acids, typically aliphatic sulfonic acids such as methyl sulfonic acid, ethyl sulfonic acid etc. and alkyl ($C_1$ to $C_4$)-substituted aromatic sulfonic acids. As the alkyl ($C_1$ to $C_4$)-substituted aromatic sulfonic acid, an aromatic sulfonic acid having one or more $C_1$ to $C_4$ alkyl groups bound thereto is used, and specifically xylene sulfonic acid, ethyl benzene sulfonic acid, mesitylene sulfonic acid, cumene sulfonic acid, diethyl benzene sulfonic acid etc. are used. In particular, alkyl ($C_1$ to $C_4$)-substituted aromatic sulfonic acids consisting of xylene sulfonic acid and ethyl benzene sulfonic acid are preferably used.

Besides these organic sulfonic acids, metal salts of organic sulfonic acid are contained in an amount of 0.5 to 20.0 by weight in the hardener composition for molding according to the present invention. These metal salts of organic sulfonic acid may be separately prepared and added to the hardener, or organic sulfonic acids and metal hydroxides may be added to the hardener and formed into metal salts of organic sulfonic acid in the system. In some cases, a part of the metal salts of organic sulfonic acid separately prepared and added to the hardener can be exchanged with salts of organic sulfonic acid originally contained in the hardener.

Further, the hardener composition for molding according to the present invention preferably contains 5.0 to 90.0% by weight of water for the purpose of regulating the hardening rate and reducing the viscosity of the hardener composition. If the content of water is less than 5.0% by weight, the effect of decreasing the viscosity is made inadequate, while the content exceeds 90.0%by weight, the acid concentration of the hardener composition is significantly decreased, leading to a significant decrease in the function of hardening the binder. That is not preferably.

Besides the metal salts of organic sulfonic acid, the organic sulfonic acids and water, it is possible to add other components e.g. alcohols such as methanol, ethanol etc., inorganic acids such as phosphoric acid, sulfuric acid etc., carboxylic acids or surfactants to the hardener composition for molding according to the present invention.

Among these, alcohols work for preventing the precipitation of alkyl ($C_1$ to $C_4$)-substituted aromatic sulfonic acids, and particularly methanol is significant in this effect and preferable.

Further, inorganic acids give an acceleration of hardening the acid hardening resin, and particularly sulfonic acid is significant in this effect and preferable.

As the sand composition for molding according to the present invention, 0.3 to 3.5 parts by weight of the binder composition for molding and 0.1 to 2.5 parts by weight of the hardener composition for molding-may be added to 100 parts by weight of a refractory granulated aggregate.

In the present invention, the refractory granulated aggregate, the binder composition, the hardener composition, and the metal salts of organic sulfonic acid can be mixed to prepare the sand composition for molding. In this case, 0.02 to 0.8% by weight of the metal salts of organic sulfonic acid are used by adding them to the sand composition for molding. In particular, the organic sulfonates are contained preferably in an amount of 0.03 to 0.50% by weight, most preferably 0.05 to 0.30% by weight. If the content of the metal salts of organic sulfonic acid is less than 0.02% by weight, the effect of improving the rate of hardening a mold is poor, and the final strength of the mold cannot be achieved to practical levels. On the contrary, if the content of the metal salts of organic sulfonic acid exceeds 0.8% by weight, the metal salts of organic sulfonic acid is made substantially inhomogeneous and the effect of improving the rate of hardening a mold is poor, and the final strength of the mold cannot be achieved to practical levels.

When the case where the metal salts of organic sulfonic acid are added uniformly to the binder composition and/or the hardener composition is compared with the above-described case where the metal salts are added separately to sand, the salts are previously uniformly dispersed (dissolved) in the former case, whereas in the latter case, dispersion of the salts in the binder composition and the hardener composition is not initiated until the binder composition, the hardener composition and the metal salts of organic sulfonic acid are contacted at the time of kneading the sand. Accordingly, the amount of the metal salts of organic sulfonic acid in the latter case should be larger than in the former in order to attain the same strength.

In the present invention, as the above mentioned-methods, the method of adding the metal salts of organic sulfonic acid includes a method of allowing them to be present in the binder composition for molding, a method of allowing them to be present in the hardener composition for molding, or a method of separately adding them in the step of kneading the binder and the hardener with the refractory granulated aggregate in producing the sand composition for molding, and these 3 methods can be used singly or in combination thereof.

The aromatic sulfonic acids in the metal salts thereof contained in the binder composition, the hardener composition and the sand composition used in the present invention include one or more compounds such as benzene sulfonic acid, toluene sulfonic acid, xylene sulfonic acid, ethyl benzene sulfonic acid, cumene sulfonic acid, and naphthalene sulfonic acid, and the metals in the metal salts include one or more metals selected from alkali metals such as sodium, potassium etc. and alkaline earth metals such as calcium, magnesium etc., preferably alkali metals, more preferably potassium.

Preferable alkali metal salts or alkaline earth metal salts of aromatic sulfonic acid are one or more members selected from compounds of the following general formula (1) or (2):

(1)

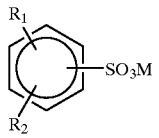

(2)

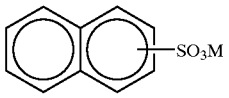

wherein $R_1$ and $R_2$ each are a hydrogen atom or an alkyl group having 1 to 4 carbon atoms, and M is an alkali metal or an alkaline earth metal.

Besides silica sand based mainly on quartz, new sand such as chromite sand, zircon sand, olivin sand, alumina sand, ceramic sand etc. or reclaimed sand thereof is used as the refractory granulated aggregate, and reclaimed sand obtained by mechanical abrasion system or calcination system can also be used, but the sand reclaimed by abrasion is high in yield, is economically superior, and is generally preferably used.

EXAMPLES

Hereinafter, the present invention is described in detail by reference to Examples, which however are not intended to limit the present invention.

Example 1

1950 parts (20.7 mol) of phenol and 36.0 parts (0.31 mol) of 48.5% aqueous sodium hydroxide were introduced into a four-necked flask equipped with a thermometer, a condenser and a stirrer, and 1014 parts (31.1 mol) of 92% paraformaldehyde was added over about 1 hour thereto at a constant temperature of 80° C., and when the viscosity of the system reached 30,000 cps at 25° C., the mixture was immediately cooled and neutralized with 50% sulfuric acid until its pH reached 5.0. After neutralization, the resulting neutralized salt was separated by centrifugation, and water was added to the separated upper layer whereby a resol type phenol resin with a water content of 20.0% was obtained. The weight average molecular weight of the resol type phenol resin was 720. Further, 0.3 part of γ-(2-amino)aminopropyl methyl dimethoxysilane was added to this resin. The sulfonates shown in Table 1 were added to the resol type phenol resin thus obtained, whereby binder compositions for forming mold, with the compositions shown in Table 1, were prepared.

1 part by weight of this binder composition for forming mold and 0.60 part by weight of a hardener composition for molding (sulfuric acid, 20.0% by weight; xylene sulfonic acid, 50.0% by weight; water, 20.0% by weight; and methanol, 10.0% by weight) were added to 100 parts by weight of Kaketsu-usen No. 5 silica sand and kneaded to give a sand composition for molding. Immediately thereafter, this sand composition for molding was introduced into a test piece frame of 50 mmϕ×50 mm height and self-hardened at 5° C. to give a test mold. After the sand composition for molding was introduced into the test piece frame, the compressive strength of the resultant test mold was measured after 1 hour and 24 hours according to a method described in JIS Z 2604-1976. The results are shown in Table 1.

Examples 2 to 26, and Comparative Examples 1 to 3

The same experiment as in Example 1 was conducted except that the type and amount of the sulfonate used were changed. The results are shown in Table 1.

TABLE 1

| | | Metal salts of Organic Sulfonic Acid | | Compressive Strength ($kg/cm^2$) | |
|---|---|---|---|---|---|
| | | Type | Weight-% in Binder Composition | 1 Hour Later | 24 Hours Later |
| Examples | 1 | potassium p-toluene sulfonate | 6.0 | 4.2 | 23.9 |
| | 2 | potassium p-toluene sulfonate | 8.3 | 4.5 | 25.4 |
| | 3 | potassium p-toluene sulfonate | 10.5 | 5.8 | 28.5 |
| | 4 | potassium p-toluene sulfonate | 13.2 | 7.5 | 30.2 |
| | 5 | potassium p-toluene sulfonate | 14.5 | 8.2 | 32.8 |
| | 6 | potassium p-toluene sulfonate | 16.4 | 7.5 | 29.8 |
| | 7 | potassium p-toluene sulfonate | 18.6 | 5.4 | 27.3 |
| | 8 | potassium p-toluene sulfonate | 21.8 | 5.0 | 25.5 |
| | 9 | potassium p-toluene sulfonate | 23.5 | 4.6 | 24.6 |
| | 10 | potassium p-toluene sulfonate | 25.0 | 4.3 | 23.5 |
| | 11 | sodium p-toluene sulfonate | 8.5 | 4.7 | 23.0 |
| | 12 | sodium p-toluene sulfonate | 12.7 | 7.5 | 31.2 |
| | 13 | sodium p-toluene sulfonate | 15.8 | 7.3 | 27.7 |
| | 14 | sodium p-toluene sulfonate | 20.1 | 5.2 | 23.8 |
| | 15 | calcium p-toluene sulfonate | 7.5 | 4.5 | 22.7 |
| | 16 | calcium p-toluene sulfonate | 9.2 | 5.3 | 23.5 |
| | 17 | calcium p-toluene sulfonate | 11.8 | 6.1 | 24.2 |
| | 18 | calcium p-toluene sulfonate | 14.0 | 7.0 | 26.0 |
| | 19 | potassium xylene sulfonate | 10.8 | 5.4 | 28.3 |
| | 20 | potassium xylene sulfonate | 12.6 | 6.8 | 29.8 |
| | 21 | potassium benzene sulfonate | 8.6 | 5.9 | 24.6 |
| | 22 | potassium benzene sulfonate | 11.6 | 6.6 | 27.5 |
| | 23 | potassium phenol sulfonate | 9.2 | 5.1 | 26.1 |
| | 24 | potassium phenol sulfonate | 15.4 | 6.3 | 27.0 |
| | 25 | potassium methane sulfonate | 7.9 | 4.0 | 22.3 |
| | 26 | potassium methane sulfonate | 11.5 | 4.2 | 24.8 |
| Comparative Examples | 1 | — | — | 2.8 | 12.7 |
| | 2 | potassium p-toluene sulfonate | 4.8 | 3.1 | 16.5 |
| | 3 | potassium p-toluene sulfonate | 25.5 | 3.8 | 15.2 |

As is evident from the results in Table 1, the strength of the mold is increased 1 hour later and 24 hours later where a metal salt of organic sulfonic acid is contained. It is understood that as the content of the organic sulfonic acid is increased gradually from 6.0% by weight, the strength of each mold is also gradually increased. In this case, it is understood that when the metal salt of organic sulfonic acid is contained in an amount of about 15%, the strength reaches a maximum and as the amount of the metal salt of organic sulfonic acid is further increased, the strength of each mold is gradually decreased, and when the content exceeds 25% by weight, the strength of each mold is not very improved. It is further understood that in the case where the content of the metal salt of organic sulfonic acid is less than 6.0% by weight, the strength of each mold is not very improved.

Example 27

In the resol type phenol before adding the metal salt of organic sulfonic acid in Example 1, the metal salt of organic sulfonic acid shown in Table 2 was mixed with a hardener containing 20.0% by weight of sulfuric acid, 50.0% by weight of xylene sulfonic acid, 20.0% by weight of water, and 10.0% by weight of methanol, thus preparing hardener compositions for molding containing the metal salt of organic sulfonic acid in the amounts (parts by weight) shown in Table 2.

The compressive strength of their test molds was measured in the same manner as in Example 1. The results are shown in Table 1.

Examples 28 to 36, and Comparative Examples 4 to 6

The same experiment as in Example 27 was conducted except that the amount of the sulfonate used was varied. The results are shown in Table 2.

TABLE 2

| | | Metal salts of Organic Sulfonic Acid | | Compressive Strength (kg/cm$^2$) | |
|---|---|---|---|---|---|
| | | Type | Weight-% in Hardener Composition | 1 Hour Later | 24 Hour Later |
| Examples | 27 | potassium p-toluene sulfonate | 0.5 | 4.2 | 22.7 |
| | 28 | potassium p-toluene sulfonate | 2.0 | 4.4 | 24.8 |
| | 29 | potassium p-toluene sulfonate | 3.5 | 5.7 | 27.0 |
| | 30 | potassium p-toluene sulfonate | 5.2 | 7.4 | 30.2 |
| | 31 | potassium p-toluene sulfonate | 7.0 | 8.1 | 32.5 |
| | 32 | potassium p-toluene sulfonate | 8.5 | 7.5 | 29.7 |
| | 33 | potassium p-toluene sulfonate | 10.0 | 5.4 | 27.0 |
| | 34 | potassium p-toluene sulfonate | 13.0 | 4.8 | 25.5 |
| | 35 | potassium p-toluene sulfonate | 16.0 | 4.4 | 24.1 |
| | 36 | potassium p-toluene sulfonate | 20.0 | 4.1 | 22.4 |
| Comparative Examples | 4 | — | — | 2.8 | 12.7 |
| | 5 | potassium p-toluene sulfonate | 0.4 | 3.1 | 16.4 |
| | 6 | potassium p-toluene sulfonate | 22.0 | 3.3 | 15.2 |

As is evident from the results in Table 2, when the metal salt of organic sulfonic acid is contained, the strength of the mold is increased 1 hour later and 24 hours later. It is understood that as the content of the organic sulfonic acid is increased gradually from 0.5% by weight, the strength of each mold is also increased gradually. In this case, it is understood that when the metal salt of organic sulfonic acid is contained in an amount of about 7%, the strength reaches a maximum and as the metal salt of organic sulfonic acid is further increased, the strength of each mold is gradually decreased, and when the content exceeds 20% by weight, the strength of each mold is not very improved. It is further understood that when the content of the metal salt of organic sulfonic acid is less than 0.5% by weight, the strength of each mold is not very improved.

Example 37

The binder compositions for molding containing predetermined amounts of a metal salt of organic sulfonic acid, besides the resol type phenol resin before adding the metal salt of organic sulfonic acid, were separately prepared as the binder in the same manner as in Example 1 (Examples 49 and 51). The hardener compositions for molding were prepared as the hardener by kneading a hardener containing 20.0% by weight of sulfuric acid, 50.0% by weight of xylene sulfonic acid, 20.0% by weight of water, and 10.0% by weight of methanol used in Example 1 with potassium p-toluene sulfonate in the amounts (parts by weight, relative to 100 parts by weight of the hardener) shown in Table 3 (Examples 50 and 51).

The metal salt of organic sulfonic acid was added as necessary to 100 parts by weight of Kaketsu-usen No. 5 silica sand, and 1 part by weight of the resol type phenol resin or the binder composition for molding containing the metal salt of organic sulfuric acid added to the resol type phenol resin was kneaded with 0.60 part by weight of the hardener used in Example 1 or the hardener composition molding containing the metal salt of organic sulfonic acid added to the hardener whereby sand compositions for forming mold were obtained. The compressive strength of their test molds was determined in the same manner as in Example 1. The results are shown in Table 3.

Examples 38 to 51, and Comparative Examples 7 to 9

The same experiment as in Example 37 was conducted except that the amount of the sulfonate used was varied. The results are shown in Table 3.

TABLE 3

| | | Metal salts of Organic Sulfonic Acid | | | | | |
|---|---|---|---|---|---|---|---|
| | | Type | Weight-% in Binder Composition | % by Weight in Hardener Composition | % by Weight in Sand Composition* | Compressive Strength (kg/cm$^2$) 1 Hour Later | 24 Hours Later |
| Examples | 37 | potassium p-toluene sulfonate | — | — | 0.0200 | 4.1 | 19.8 |
| | 38 | potassium p-toluene sulfonate | — | — | 0.0300 | 4.2 | 22.5 |
| | 39 | potassium p-toluene sulfonate | — | — | 0.0400 | 4.3 | 24.8 |
| | 40 | potassium p-toluene sulfonate | — | — | 0.0500 | 4.3 | 25.3 |
| | 41 | potassium p-toluene sulfonate | — | — | 0.0750 | 5.5 | 26.5 |
| | 42 | potassium p-toluene sulfonate | — | — | 0.1200 | 7.2 | 28.0 |
| | 43 | potassium p-toluene sulfonate | — | — | 0.1500 | 7.9 | 30.0 |
| | 44 | potassium p-toluene sulfonate | — | — | 0.2500 | 7.4 | 27.7 |
| | 45 | potassium p-toluene sulfonate | — | — | 0.3500 | 5.4 | 24.0 |
| | 46 | potassium p-toluene sulfonate | — | — | 0.4500 | 4.5 | 22.0 |

TABLE 3-continued

| | | Metal salts of Organic Sulfonic Acid | | | | | |
|---|---|---|---|---|---|---|---|
| | | Type | Weight-% in Binder Composition | % by Weight in Hardener Composition | % by Weight in Sand Composition* | Compressive Strength (kg/cm$^2$) 1 Hour Later | 24 Hours Later |
| | 47 | potassium p-toluene sulfonate | — | — | 0.5500 | 4.1 | 19.5 |
| | 48 | potassium p-toluene sulfonate | — | — | 0.6000 | 3.8 | 17.8 |
| | 49 | potassium p-toluene sulfonate | 7.5 | — | — | 4.4 | 24.5 |
| | 50 | potassium p-toluene sulfonate | — | 3.5 | — | 5.7 | 27.0 |
| | 51 | potassium p-toluene sulfonate | 7.5 | 3.5 | — | 5.5 | 26.8 |
| Comparative Examples | 7 | — | — | — | — | 2.8 | 12.7 |
| | 8 | potassium p-toluene sulfonate | — | — | 0.0180 | 3.0 | 16.2 |
| | 9 | potassium p-toluene sulfonate | — | — | 0.8300 | 3.1 | 15.1 |

*The amount based on only the metal salt of organic sulfonic acid added separately from the binder composition and/or the hardener composition is described.

As is evident from the results in Table 3, when the metal salt of organic sulfonic acid is contained, the strength of the mold is high 1 hour later and 24 hours later. It is understood that as the content of the organic sulfonic acid is increased gradually from 0.02% by weight, the strength of each mold is also increased gradually. In this case, it is understood that when the metal salt of organic sulfonic acid is contained in an amount of about 0.15%, the strength reaches a maximum and as the metal salt of organic sulfonic acid is further increased, the strength of each mold is gradually decreased, and when the content exceeds 0.8% by weight, the strength of each mold is not very improved. It is further understood that when the content of the metal salt of organic sulfonic acid is less than 0.02%by weight, the strength of each mold is not very improved.

What is claimed is:

1. A sand mold binder composition for molding by self-hardening comprising:

a resol phenol resin, and 8.0 to 25.0% by weight of an alkali metal salt or an alkaline earth metal salt of an aromatic sulfonic acid, wherein said the resol phenol resin has a weight average molecular weight of 200 to 2500 and is produced by using an alkali catalyst at a molar ratio of 0.001 to 0.2 to a phenol.

2. A hardener composition for hardening a resol phenol resin binder composition consisting essentially of:

0.5 to 20.0% by weight of an alkali metal salt or an alkaline earth metal salt of an aromatic sulfonic acid, and 5.0 to 95.0 wt. % of a free organic sulfonic acid.

3. A sand composition for molding by self-hardening obtained by mixing a refractory granulated aggregate, a binder composition containing a resol phenol resin, and a hardener composition, wherein at least one of the binder composition and the hardener composition is defined in claim 1 or 2.

4. A sand composition for molding by self-hardening obtained by mixing:

100 parts by weight of a sand, 0.3 to 3.5 parts by weight of a sand mold binder composition containing a resol phenol resin, wherein the resol phenol resin has a weight average molecular weight of 200 to 2500 and is produced by using an alkali catalyst at a molar ratio of 0.001 to 0.2 to a phenol, 0.1 to 2.5 of a hardener composition comprising 5.0 to 95.0 wt. % of a free organic sulfonic acid, and an alkali metal salt or an alkaline earth metal salt of an aromatic sulfonic acid, wherein the alkali metal salt or an alkaline earth metal salt of an aromatic sulfonic acid is present in an amount of 0.02 to 0.8% by weight in the sand composition.

5. The sand mold binder composition for molding by self-hardening according to claim 1, wherein the alkali metal salt or an alkaline earth metal salt of an aromatic sulfonic acid is selected from the group consisting of compounds of formula (1), formula (2) and mixtures thereof:

(1)

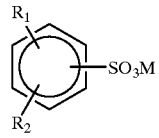

(2)

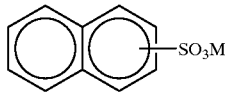

wherein $R_1$ and $R_2$ each are a hydrogen atom or an alkyl group having 1 to 4 carbon atoms, and M is an alkali metal or an alkaline earth metal.

6. The hardener composition for molding by self-hardening according to claim 2, wherein the alkali metal salt or an alkaline earth metal salt of an aromatic sulfonic acid is selected from the group consisting of compounds of formula (1), formula (2) and mixtures thereof:

(1)

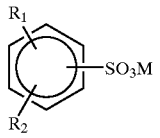

(2)

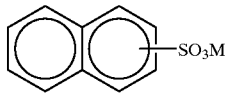

wherein $R_1$ and $R_2$ each are a hydrogen atom or an alkyl group having 1 to 4 carbon atoms, and M is an alkali metal or an alkaline earth metal.

7. The sand composition for molding by self-hardening according to claim 4, wherein the alkali metal salt or an alkaline earth metal salt of an aromatic sulfonic acid is selected from the group consisting of compounds of formula (1), formula (2) and mixtures thereof:

(1)

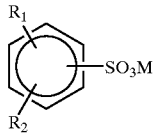

(2)

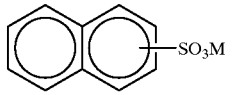

wherein $R_1$ and $R_2$ each are a hydrogen atom or an alkyl group having 1 to 4 carbon atoms, and M is an alkali metal or an alkaline earth metal.

8. The sand mold binder composition for molding by self-hardening according to claim 1, wherein the aromatic sulfonic acid is benzene sulfonic acid, toluene sulfonic acid, xylene sulfonic acid, naphthalene sulfonic acid, ethyl benzene sulfonic acid, cumene sulfonic acid or mixtures thereof, and the alkali metal salt or alkaline earth metal is sodium, potassium, calcium, magnesium or mixtures thereof.

9. The sand mold binder composition for molding by self-hardening according to claim 1, wherein the resol phenol resin is produced by:

(a) addition-condensing a phenol compound and an aldehyde compound under alkaline conditions, (b) neutralizing with an aromatic sulfonic acid, wherein the alkali metal salt or the alkaline earth metal salt of the aromatic sulfonic acid can be present in the binder.

10. The sand mold binder composition for molding by self-hardening according to claim 1, wherein the alkali metal salt or an alkaline earth metal salt of an aromatic sulfonic acid is present in an amount of 10.0 to 18% by weight in the sand mold binder composition.

11. The sand mold binder composition for molding by self-hardening according to claim 1, comprising:

(a) 30 to 95% by weight of at least one resol phenol resin, (b) 0.5 to 50% by weight of water, and (c) 8.0 to 25% by weight of the alkali metal salt or alkaline earth metal salt of aromatic sulfonic acid.

12. A process for preparing a sand mold, comprising:

mixing, in the presence of 0.5 to 20.0% by weight of an alkali metal salt or an alkaline earth metal salt of an aromatic sulfonic acid, 100 parts by weight of a sand, 0.3 to 3.5 parts by weight of a sand mold binder composition containing a resol phenol resin, wherein the resol phenol resin has a weight average molecular weight of 200 to 2500 and is produced by using an alkali catalyst at a molar ratio of 0.001 to 0.2 to a phenol, and 0.1 to 2.5 parts by weight of a hardener composition comprising 5.0 to 95.0 wt. % of a free organic sulfonic acid; and curing the mixture.

* * * * *